US005803303A

United States Patent [19]

Timm et al.

[11] Patent Number: 5,803,303

[45] Date of Patent: Sep. 8, 1998

[54] VENTED FOOT HELD WASTE BASKET

[76] Inventors: Rickey Timm; Janine Timm, both of 2880 S. Hilltop Dr., Knox, Ind. 46534

[21] Appl. No.: 55,816

[22] Filed: Apr. 7, 1998

[51] Int. Cl.[6] ..... B65D 25/16

[52] U.S. Cl. ..... 220/495.04; 220/908.01

[58] Field of Search ..... 220/495.04, 908, 220/913

[56] References Cited

U.S. PATENT DOCUMENTS

| | | | |
|---|---|---|---|
| 1,286,368 | 12/1918 | Lucas . | |
| 3,306,486 | 2/1967 | Martino et al. | 220/1 |
| 4,363,417 | 12/1982 | Rhoades et al. | 220/1 T |
| 4,440,321 | 4/1984 | Campbell et al. | 222/153 |
| 4,763,809 | 8/1988 | Miller et al. | 220/407 |
| 4,890,760 | 1/1990 | Nicoll, Sr. et al. | 220/404 |
| 4,913,308 | 4/1990 | Culbertson | 220/495.04 |
| 5,163,579 | 11/1992 | Jones | 220/629 |
| 5,213,228 | 5/1993 | Chang | 220/495.04 |
| 5,375,732 | 12/1994 | Bowers et al. | 220/404 |
| 5,388,717 | 2/1995 | Levasser | 220/404 |
| 5,390,812 | 2/1995 | Spiro | 220/403 |
| 5,390,818 | 2/1995 | Labuk | 220/404 |

*Primary Examiner*—Joseph M. Moy
*Attorney, Agent, or Firm*—John D. Gugliotta

[57] ABSTRACT

A vented, foot held waste basket is disclosed, comprised of a traditional, upstanding waste basket, formed from a main housing. An arched shaped, foot securement cavity is located at the bottom of the main housing, running completely through the main housing, and being formed from the bottom of the main housing and an arched member. The foot securement cavity is designed to permit a standard man's boot to enter and secure the main housing to the floor during removal of a refuse liner from the main housing. Located along the apex of the arched member are a plurality of evenly spaced vacuum holes designed to reduce the vacuum created by the refuse liner and main housing during removal of the refuse liner.

10 Claims, 4 Drawing Sheets

VENTED FOOT HELD WASTE BASKET

BACKGROUND OF THE INVENTION

1. Field of the Invention

The present invention relates generally to trash receptacles and, more particularly, to a vented, foot held waste basket.

2. Description of the Related Art

Refuse containers, also known as trash receptacles, are commonly used in homes to store household refuse in a convenient location. Most of these devices are designed to be used with refuse liners, also known as plastic bags. The user fills the refuse liner with garbage, and when the liner is full, the user lifts the refuse liner out of the garbage can.

Problems with leakage from the refuse liners happen with conventional garbage cans for three reasons. First, inexpensive refuse liners are not constructed sufficiently strong to withstand heavy loads of garbage, and, therefore, tear while being pulled from the waste basket. Second, operators overfill the refuse liners because no one wants to deal with removing a liner that is usually difficult to remove. Third, operators drop glass or other sharp objects into the trash receptacle, thus tearing the refuse liner.

Removal of liners from the housing of a garbage receptacle can be difficult and dangerous to the health of the operator. The vertical forces required to lift the refuse liner above the rim of the garbage can be significant, causing injury to many users. The weak and the infirm, as well as the young and elderly, are at risk of injury, finding it difficult to generate the vertical forces required to remove the refuse liner.

The bending and tugging at the refuse liner is a tedious task, mainly due to the vacuum created between the refuse liner and the sides of the container. The vacuum forms between the liner and the container when the pressure exerted on the walls of the container creates a seal around its perimeter, increasing proportionately as the liner is removed.

Devices in the previous art attempt to address this problem by providing vacuum releasing means of some sort. Examples of such devices include U.S. Pat. No. 5,375,732, issued in the name of Bowers et al. and U.S. Pat. No. 4,890,760, issued in the name of Nicoll, Sr. et al.

Another problem associated with refuse containers that use refuse liners is the lifting of the container during removal of the liner. The rubbish in a full refuse liner places pressure on the walls of the container that creates friction and results in resistance against the garbage can during removal of the refuse liner. Devices in the previous art attempt to address this problem by utilizing foot pads located external to the main housing of the garbage can. Examples of such devices include U.S. Pat. No. 5,390,812, issued in the name of Spiro, and U.S. Pat. No. 5,163,579, issued in the name of Jones.

To use devices such as the '812 and '579 device, the user places his or her foot on these foot pads to hold the garbage can on the ground during removal of the refuse liner. The first problem with these devices is that the foot pads have a tendency to disconnect from the garbage can. Second, the foot pads get in the way of ordinary use of the garbage can by not allowing the garbage can to sit flush against the wall in the corner of a room, since they often extend outward horizontally from the main body of the trash receptacle. Third, infants can trip over the foot pads and fall.

A search of the prior art did not disclose any patents that read directly on the claims of the instant invention.

Consequently, a need has been felt for providing an apparatus and method which overcomes the problems cited above.

SUMMARY OF THE INVENTION

It is therefore an object of the present invention to provide an improved vented, foot held waste basket of novel design that facilitates the easy removal of refuse liners from waste baskets without tearing the refuse liner.

Briefly described according to one embodiment of the present invention, a vented, foot held waste basket is disclosed, comprised of a traditional, upstanding waste basket, formed from a main housing. An arched shaped, foot securement cavity is located at the bottom of the main housing, running completely through the main housing, and being formed from the bottom of the main housing and an arched member. The foot securement cavity is designed to permit a standard men's boot to enter and secure the main housing to the floor during removal of a refuse liner from the main housing. Located along the apex of the arched member are a plurality of evenly spaced, vacuum holes designed to reduce the vacuum created by the refuse liner and main housing during removal of the refuse liner.

It is another object of the present invention to provide venting that reduces the vacuum created between the refuse liner and the inside walls of the refuse container.

It is another object of the present invention to provide a cavity designed to permit entry of a man's work boot, thereby assisting the user in keeping the garbage can in contact with the ground during removal of the refuse liner, helping the user to deal with the friction created between a full refuse liner and the main housing of a trash receptacle. Such a feature also provides the advantage of allowing the user to utilize both hands to remove the refuse liner.

It is another object of the present invention to provide a cavity that is centrally located, providing the benefit of creating vertical force to resist lifting of the trash receptacle along its center of gravity, thus reducing the likelihood of tilting of the trash receptacle laterally in either direction during removal of the refuse liner.

It is another object of the present invention to provide a design that can be incorporated into any type of trash receptacle.

It is another object of the present invention to provide a device that is simple to maintain, and easy and inexpensive to manufacture.

DESCRIPTIVE KEY

| | |
|---|---|
| 10 | vented, foot held waste basket |
| 20 | main housing |
| 30 | top |
| 40 | bottom |
| 50 | side wall |
| 70 | posterior wall |
| 80 | arched member |
| 90 | foot securement cavity |
| 100 | cavity opening |
| 110 | vacuum hole |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 7.

1. Detailed Description of the Figures

Figure 1:
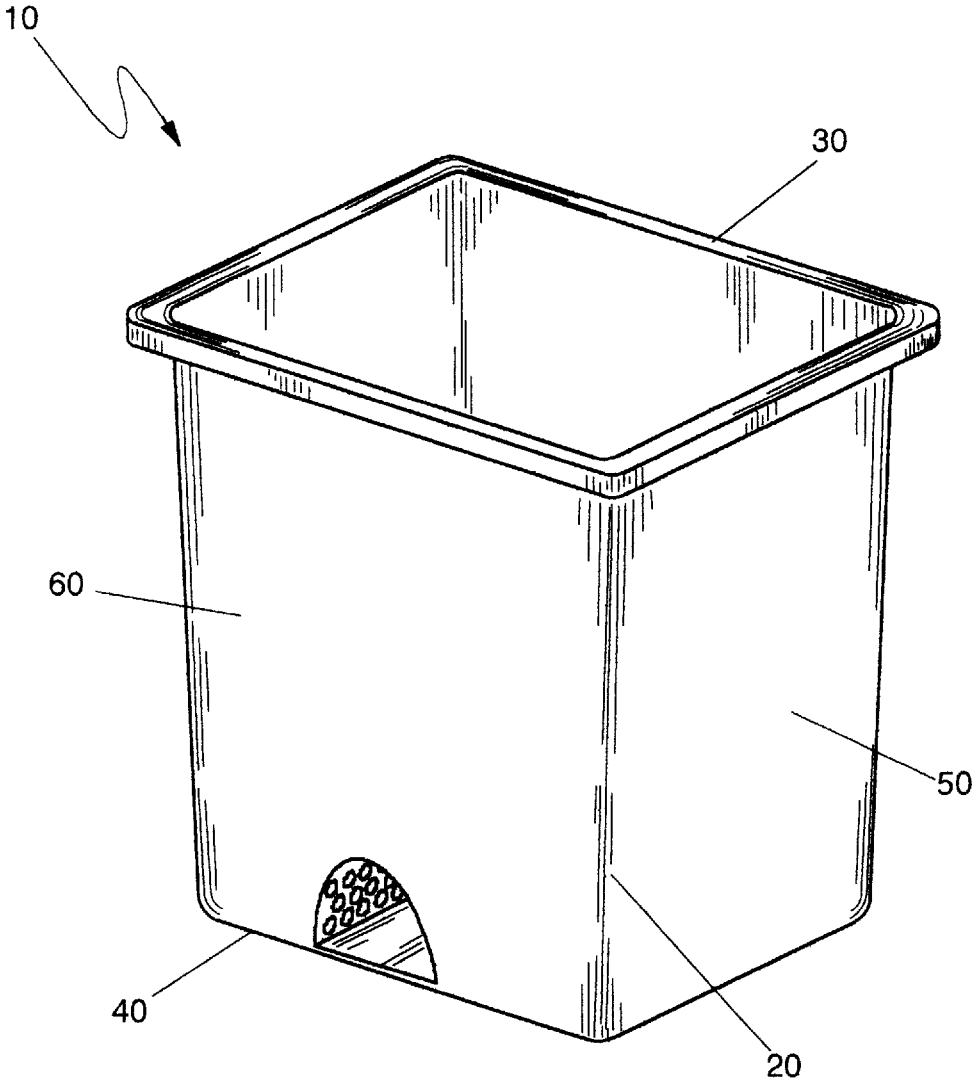
FIG. 1 is a front perspective view of the preferred embodiment of a vented, foot held waste basket 10.

Referring now to FIG. 1, a vented, foot held waste basket 10 is shown, according to the present invention, designed to be used with a refuse liner 15. The vented, foot held waste basket 10 comprises a main housing 20. It is envisioned that the main housing 20 is of a vertically elongated, upstanding rectangular configuration, having an open top 30 and a closed bottom 40, and generally impervious side walls 50, an anterior wall 60 and a posterior wall 70, attached to the bottom 40 along their common edges to form a receptacle for receiving a refuse liner 15 that holds trash or debris therein. The main housing 20 is made of a plastic material, however, it should be noted that other conventional material may be used for making the same. It should further be noted that the size of the main housing 20 may be varied to accommodate the use thereof in different applications, i.e., in commercial and residential application.

Figure 2:
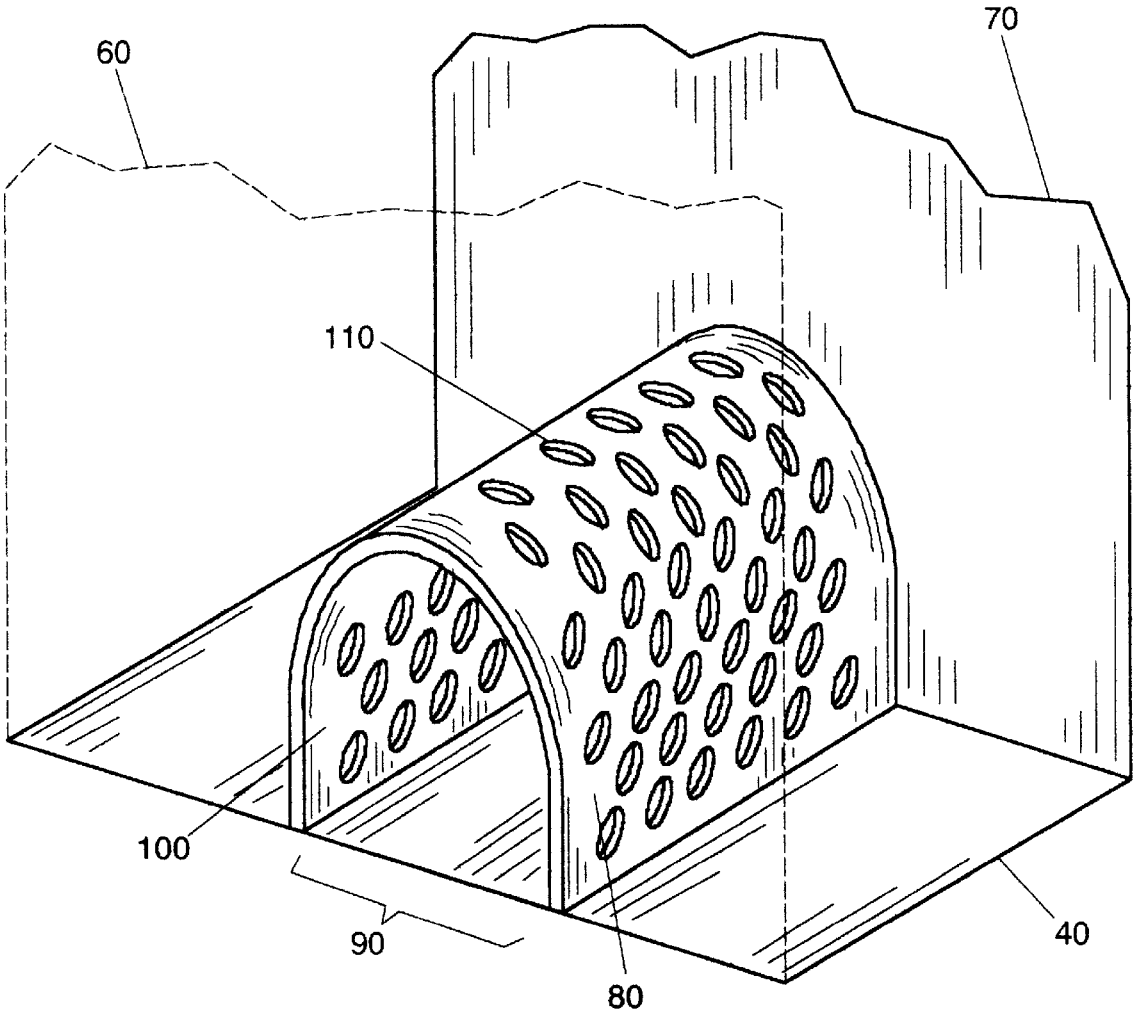
FIG. 2 is a partial front perspective view thereof.

Referring now to FIG. 2, it is envisioned that connected to the upper surface of the bottom 40 of the main housing 20 is an arched member 80. The arched member 80 is connected to the bottom 40 along two parallel, horizontal lines that are equidistant and parallel to the horizontal centerline of the bottom 40 of the main housing 20, between the anterior wall 60 and posterior wall 70, forming an arch of approximately 180 degrees. The arched member 80 extends along the entire depth of the interior volume of the main housing 20, connected at either end to the anterior wall 60 and posterior wall 70, so as to form a self-enclosed, foot securement cavity 90, of an arched shaped configuration, as seen from the front of the present invention.

A foot securement cavity 90 is formed from the main housing 20. The lower surface of the foot securement cavity 90 is formed from the bottom 40 of the main housing 20. The sides and upper surface of the foot securement cavity 90 are formed by the arched member 80.

Figure 3:
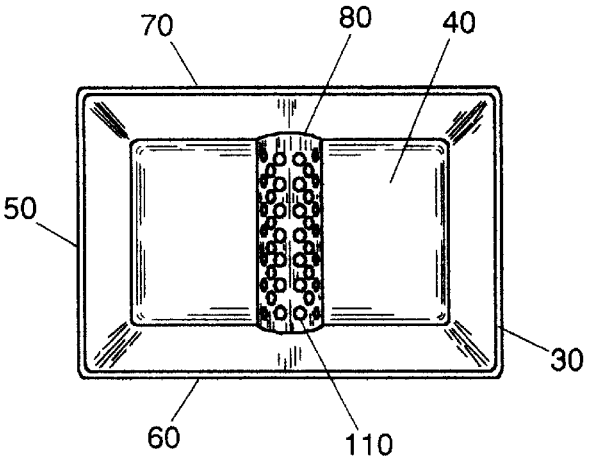
FIG. 3 is a top view thereof.

Referring now to FIG. 3, the centerline of the foot securement cavity 90 is in linear alignment with the horizontal centerline of the main housing 20, spanning between the anterior wall 60 and posterior wall 70 of the main housing 20.

Figure 4:
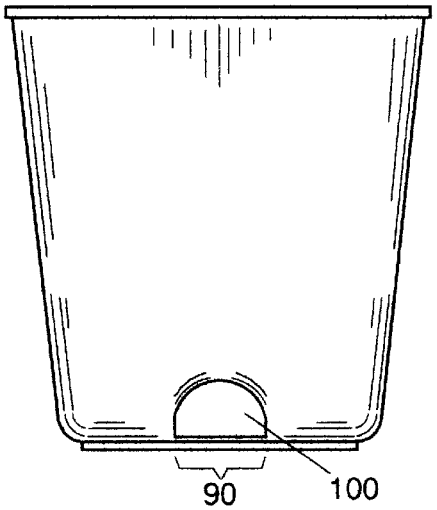
FIG. 4 is a front view thereof.

Referring now to FIG. 4, the foot securement cavity 90 is a linearly elongated passage that completely passes through the main housing 20, creating cavity openings 100 located along both the anterior wall 60 and posterior wall 70 of the main housing 20.

The lateral width and vertical height of the foot securement cavity 90 are sufficient to permit a standard men's work boot to slidably engage the foot securement cavity 90, penetrating a sufficient distance to create sufficient mechanical interference between the work boot and lower surface of the foot securement cavity 90 so as to facilitate the securement of the main housing 20 to the floor during removal of a refuse liner 15.

Figure 5:
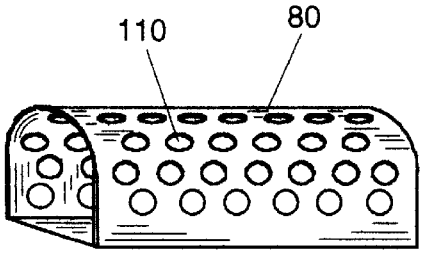
FIG. 5 is a side view of the arched member.

Referring now to FIG. 5, located along the apex of the upper surface of the arched member 80 are a plurality of evenly spaced, vacuum holes 110. Each vacuum hole 110 is of a sufficient cross sectional diameter, such that as a group, sufficient air flow can pass into and out of the main housing 20 to reduce the vacuum created between the refuse liner 15 and sides of the main housing 20 during removal of a refuse liner 15.

Figure 6:
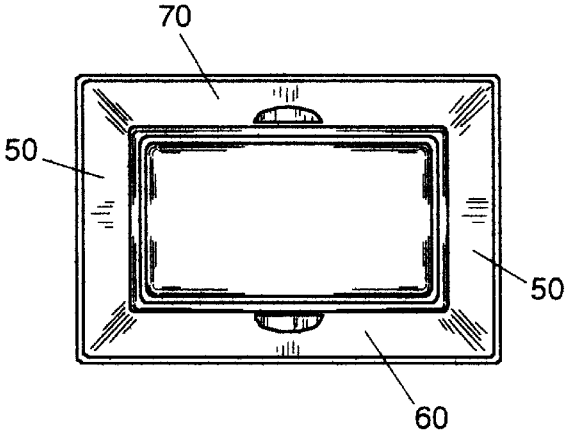
FIG. 6 is a bottom view of the preferred embodiment.

FIG. 6 is a bottom 40 view of the main housing 20, illustrating the general shape of the preferred embodiment of the present invention.

It is envisioned that other styles and configurations of the main housing 20 and foot securement cavity 90 can be easily incorporated into the teachings of the present invention, and only one particular configuration shall be shown and described for purposes of clarity and disclosure and not by way of limitation of scope.

2. Operation of the Preferred Embodiment

Figure 7:
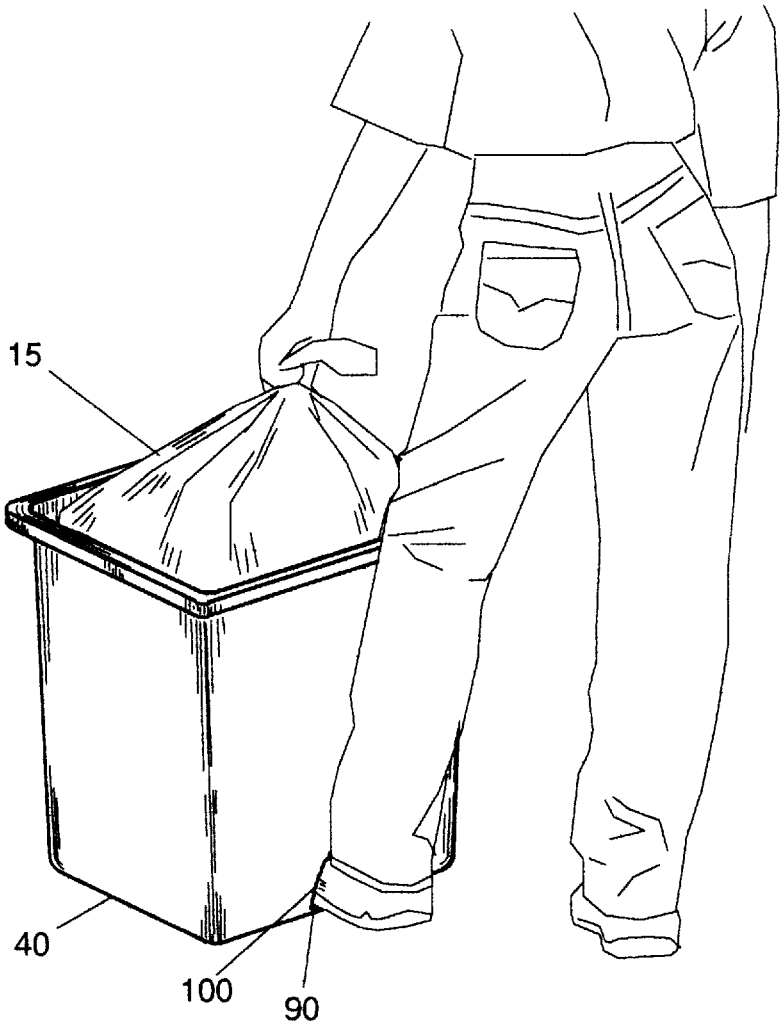
FIG. 7 is an elevational view thereof in use.

Referring now to FIG. 7, to use the present invention, the operator places a refuse liner 15 in the main housing 20 in the traditional manner. When the refuse liner 15 is full, the operator places his or her foot into the foot securement cavity 90 and lifts the refuse liner 15 from the main housing 20. Lifting is facilitated by the vacuum holes 110, which reduce the vacuum created by the refuse liner 15 and main housing 20 during removal of the refuse liner 15. Next, the operator ties the refuse liner 15 and replaces the full refuse liner 15 with a fresh refuse liner 15.

The foregoing description is included to illustrate the operation of the preferred embodiment and is not meant to limit the scope of the invention. The scope of the invention is to be limited only by the following claims.

What is claimed is:

1. A vented, foot held waste basket comprising:

a main housing, constructed of plastic, of a vertically elongated, upstanding rectangular configuration, having an open top and a closed bottom, said bottom having an upper surface, and generally impervious side walls, an anterior wall and a posterior wall, attached to the bottom along their common edges to form a receptacle for receiving a refuse liner that holds trash or debris therein;

an arched member of a generally linearly elongated, arch shape configuration, said arched member having a lower surface, and said arched member being connected to the bottom of said main housing;

a foot securement cavity; formed by said bottom of said main housing and said arched member, having a lower surface, sides and an upper surface, and designed to facilitate the sliding engagement of a traditional men's boot to secure said main housing to the floor during removal of said refuse liner;

cavity openings, of a generally arched configuration, located along both said anterior wall and posterior wall of said main housing, and designed to permit entry of a men's boot into said foot securement cavity; and vacuum holes, said vacuum holes located along the apex of said arched member and designed to reduce the vacuum created by said refuse liner and said main housing during removal of said refuse liner.

2. The vented, foot held waste basket described in claim 1, wherein said arched member is connected to said upper surface of said bottom of said main housing, along two parallel, horizontal lines that are equidistant and parallel to the horizontal centerline of said bottom of said main housing, between said anterior wall and posterior wall, forming an arch of 180 degrees.

3. The vented, foot held waste basket described in claim 1, wherein said arched member extends along the entire horizontal depth of the interior volume of said main housing, connected at either end to said anterior wall and posterior wall, so as to form a self-enclosed, foot securement cavity, of an arched shaped configuration, as seen from the front of the present invention.

4. The vented, foot held waste basket described in claim 1, wherein said foot securement cavity is formed from said main housing with said lower surface of said foot securement cavity is formed from said bottom of said main housing and said sides and upper surface of said foot securement cavity are formed by said arched member.

5. The vented, foot held waste basket described in claim 1, wherein said the centerline of said foot securement cavity is in linear alignment with the horizontal centerline of said main housing, spanning between said anterior wall and posterior wall of said main housing.

6. The vented, foot held waste basket described in claim 1, wherein said foot securement cavity is a linearly elongated passage that completely passes through said main housing, creating cavity openings located along both said anterior wall and posterior wall of said main housing.

7. The vented, foot held waste basket described in claim 1, wherein the lateral width and vertical height of said foot securement cavity are sufficient to permit a standard men's work boot to slidably engage said foot securement cavity, penetrating a sufficient distance to create sufficient mechanical interference between the work boot and lower surface so as to facilitate the securement of said main housing to the floor during removal of a refuse liner.

8. The vented, foot held waste basket described in claim 1, wherein said vacuum holes are located evenly spaced along the apex of said upper surface of said arched member, with each vacuum hole is of a sufficient cross sectional diameter, such that as a group, sufficient air flow can pass into and out of said main housing to reduce the vacuum created between said refuse liner and sides of said main housing during removal of a refuse liner.

9. The vented, foot held waste basket described in claim 1, wherein to use the present invention; first, the operator places a refuse liner in said main housing in the traditional manner; second, when said refuse liner is full, the operator places his or her foot into said foot securement cavity and lifts said refuse liner from said main housing; lifting is facilitated by said vacuum holes, which reduce the vacuum created by said refuse liner and main housing during removal of said refuse liner; third, the operator ties said refuse liner and replaces said full refuse liner with a fresh refuse liner.

10. The vented, foot held waste basket described in claim 1, wherein a fluid reservoir is created between the basket walls and the arched member such that any leakage penetrate a conventional waste basket liner would be retained and not penetrate said vent holes.

* * * * *